US011486231B1

(12) United States Patent
Rowaihy et al.

(10) Patent No.: US 11,486,231 B1
(45) Date of Patent: Nov. 1, 2022

(54) MULTILATERAL WELL ACCESS SYSTEMS AND RELATED METHODS OF PERFORMING WELLBORE INTERVENTIONS

(71) Applicant: Saudi Arabian Oil Company, Dhahran (SA)

(72) Inventors: Feras Hamid Rowaihy, Dhahran (SA); Carl Daniel Lindahl, Dhahran (SA); Suresh Jacob, Dhahran (SA); Ahmed A. Al Sulaiman, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/380,870

(22) Filed: Jul. 20, 2021

(51) Int. Cl.
*E21B 41/00* (2006.01)

(52) U.S. Cl.
CPC ..... *E21B 41/0042* (2013.01)

(58) Field of Classification Search
CPC ... E21B 41/0035; E21B 23/12; E21B 41/0042
See application file for complete search history.

(56) References Cited

U.S. PATENT DOCUMENTS

| | | | | |
|---|---|---|---|---|
| 9,506,325 | B2 | 11/2016 | Fould et al. | |
| 10,563,483 | B2 | 2/2020 | Steele | |
| 10,590,741 | B2 | 3/2020 | Van Der Veen et al. | |
| 2004/0055752 | A1* | 3/2004 | Restarick | E21B 34/08 166/117.6 |
| 2015/0226042 | A1* | 8/2015 | Barker | E21B 7/046 166/381 |
| 2015/0315850 | A1* | 11/2015 | Hallundbæk | E21B 41/0035 166/241.5 |
| 2016/0145956 | A1* | 5/2016 | Dahl | E21B 41/0035 166/117.6 |
| 2018/0274300 | A1 | 9/2018 | Vemuri et al. | |
| 2019/0040719 | A1* | 2/2019 | Rodriguez | E21B 41/0042 |

(Continued)

FOREIGN PATENT DOCUMENTS

| | | |
|---|---|---|
| CA | 2802988 | 12/2011 |
| WO | WO 2013044300 | 4/2013 |

(Continued)

OTHER PUBLICATIONS

Abubaker et al., "Technology Trial Review: Selective Coiled Tubing Re-Entry of Two Open Hole Multilateral Wells Using Intelligent Electromechanical Arm," SPE-182996-MS, Society of Petroleum Engineers (SPE), presented at the Abu Dhabi International Petroleum Exhibition & Conference, Abu Dhabi, UAE, Nov. 7-10, 2016, 14 pages.

(Continued)

*Primary Examiner* — Kipp C Wallace
(74) *Attorney, Agent, or Firm* — Fish & Richardson P.C.

(57) ABSTRACT

A multilateral well access system includes a directional guide and a mating surface profile. The directional guide includes a main body and an outer surface profile disposed on the main body. The main body defines a guide surface oriented non-parallelly to an elongate axis of the main body and a bore passing through the main body along the elongate axis. The mating surface profile is formed complementary to the outer surface profile of the directional guide and is engaged with the outer surface profile to secure the directional guide in a fixed position.

19 Claims, 5 Drawing Sheets

(56) References Cited

U.S. PATENT DOCUMENTS

| | | | | |
|---|---|---|---|---|
| 2020/0256128 | A1* | 8/2020 | Cho | E21B 33/124 |
| 2020/0256129 | A1* | 8/2020 | Kuhlman | E21B 41/0035 |
| 2021/0010350 | A1* | 1/2021 | Steele | E21B 34/14 |

FOREIGN PATENT DOCUMENTS

| | | |
|---|---|---|
| WO | WO 2018111103 | 6/2018 |
| WO | WO 2019099038 | 5/2019 |

OTHER PUBLICATIONS

Al-Khaldy et al., "First-Ever Level 4 Multilateral Well in North Kuwait Successfully Completed, Improves Oil Production," SPE-171792-MS, Society of Petroleum Engineers (SPE), presented at the Abu Dhabi International Petroleum Exhibition and Conference, Abu Dhabi, UAE, Nov. 10-13, 2014, 12 pages.

Aruhke et al., "Technology Evolution in a Giant Saudi Aramco's Field Development," WPC-21-0182, Work Petroleum Congress (WPC), presented at the 21st World Petroleum Congress, Moscow, Russia, Jun. 2014, 17 pages.

Halliburton, "IsoRite Isolated Multilateral Completion Systems: for multilateral wells that require re-entry capability to access the lateral," 2018, 3 pages.

Saeed et al., "Multilateral Reentry System for Well Surveillance: Design, Implementation and Summary of 40 Jobs Performed in Fields," SPE-199849-MS, Society of Petroleum Engineers (SPE), presented at the SPE/ICoTA Well Intervention Conference and Exhibition, The Woodlands, Texas, Mar. 24-25, 2020, 9 pages.

Schlumberger, "Discovery MLT: Multilateral reentry system," 2021, 3 pages.

Schlumberger, "SLIC: Selective lateral intervention completion system," 2019, 2 pages.

* cited by examiner

MULTILATERAL WELL ACCESS SYSTEMS AND RELATED METHODS OF PERFORMING WELLBORE INTERVENTIONS

TECHNICAL FIELD

This disclosure relates to multilateral well access systems and associated methods of performing an intervention operation at a multilateral well.

BACKGROUND

Multilateral well completions can allow for maximum reservoir contact with minimum drilling costs and reduced surface location requirements. For example, multilateral wells may offer higher production indices, the possibility of draining relatively thin formation layers, decreased well requirements, and better sweep efficiencies. Conventionally, through-tubing intervention into laterals may be achieved through a dedicated completion system installed during a drilling phase or through a re-entry guide and an access bottom hole assembly with features for locating a target lateral.

SUMMARY

This disclosure relates to a multilateral well access system and a method of performing an intervention operation at a multilateral well using the system. The system includes multiple directional guides and multiple cooperating surface profiles positioned at respective target branches of a multilateral well. Each directional guide includes an upper guide surface that is formed to deflect an intervention tool into a target branch and includes a bypass port that is sized to allow through passage of the intervention tool. Each directional guide also has an exterior key that is formed complementary to the cooperating surface profile to ensure correct positioning of the directional guide at the surface profile. The bypass port may be plugged to prevent the intervention tool from passing through to a lower branch located more deeply within the multilateral well and to ensure that the intervention tool enters the branch located adjacent the directional guide. The bypass port may also be in an open state to allow the intervention tool to pass through the directional guide to access a lower branch.

In one aspect, a multilateral well access system includes a directional guide and a mating surface profile. The directional guide includes a main body and an outer surface profile disposed on the main body. The main body defines a guide surface oriented non-parallelly to an elongate axis of the main body and a bore passing through the main body along the elongate axis. The mating surface profile is formed complementary to the outer surface profile of the directional guide and is engaged with the outer surface profile to secure the directional guide in a fixed position.

Embodiments may provide one or more of the following features.

In some embodiments, the main body has a tapered shape.

In some embodiments, the guide surface is orientated at an obtuse angle with respect to the elongate axis.

In some embodiments, the outer surface profile is positioned on opposite sides of the main body, and the inner surface profile is positioned on the opposite sides of the main body.

In some embodiments, the multilateral well access system further includes a plug that is sized to be positioned within the bore to close the bore.

In some embodiments, the main body defines a landing seat that extends within the bore to prevent through passage of the plug.

In some embodiments, the multilateral well access system further includes an entry guide that is sized to be positioned within the bore to direct a tool into the bore.

In some embodiments, the entry guide includes a tapered portion.

In some embodiments, the directional guide further includes an attraction device for attracting a tool to the bore.

In some embodiments, the attraction device includes one or both of a magnet and an electronic device.

In some embodiments, the directional guide further includes a detection device for detecting the presence of a tool within the bore.

In some embodiments, the detection devices includes an electronic sensor.

In some embodiments, the directional guide further includes a high-pressure seal that surrounds the main body.

In some embodiments, the mating surface profile is arranged on a casing that surrounds the directional guide.

In some embodiments, the directional guide is a first directional guide, the main body is a first main body, the guide surface is a first guide surface, the bore is a first bore having a first diameter, the outer surface profile is a first outer profile, the mating surface profile is a first mating surface profile, the fixed position is a first fixed position, and the multilateral well access system further includes a second directional guide and a second mating surface profile. The second directional guide includes a second main body and a second outer surface profile disposed on the second main body. The second directional guide defines a second guide surface oriented non-parallelly to an elongate axis of the second main body and a second bore passing through the second main body along the elongate axis and having a second diameter. The second mating surface profile is formed complementary to the second outer surface profile and is engaged with the second outer surface profile to secure the second directional guide in a second fixed position.

In some embodiments, the second fixed position is downhole of the first fixed position.

In some embodiments, the first diameter of the first bore is larger than the second diameter of the second bore.

In some embodiments, the second directional guide is spaced axially apart from the first directional guide.

In some embodiments, the first outer surface profile has a first shape and the second outer profile has a second shape that is different from the first shape.

In some embodiments, the first mating surface profile is configured to prevent secure positioning of the second directional guide at the first mating surface profile.

In another aspect, a method of performing an intervention operation at a multilateral well includes deploying a directional guide to an axial position within the multilateral well at which a lateral section of the multilateral well is located, installing a main body of the directional guide to an inner surface profile arranged along a casing that surrounds the directional guide at the axial position, closing a bore that passes through the main body along an elongate axis of the main body, deflecting an intervention assembly along a guide surface of the main body into the lateral section, and controlling the intervention assembly to perform the intervention operation within the lateral section.

Embodiments may provide one or more of the following features.

In some embodiments, the method further includes engaging an outer surface profile disposed on the main body with the inner surface profile arranged along the casing to secure the directional guide at the axial position within the multilateral well.

In some embodiments, the outer surface profile is formed complementary to the inner surface profile.

In some embodiments, the main body has a tapered shape.

In some embodiments, the guide surface is orientated at an obtuse angle with respect to the elongate axis.

In some embodiments, the method further includes landing a plug on a landing seat positioned along the bore to close the bore.

In some embodiments, the method further includes withdrawing the plug from the directional guide to reopen the bore.

In some embodiments, the method further includes placing an entry guide within the bore.

In some embodiments, the entry guide includes a tapered portion.

In some embodiments, the directional guide is a first directional guide, the main body is a first main body, the guide surface is a first guide surface, the bore is a first bore having a first diameter, the inner surface profile is a first inner surface profile, the lateral section is a first lateral section, the axial position is a first axial position, and the method further includes passing the intervention assembly through the first bore to access a second directional guide located downhole of the first directional guide.

In some embodiments, the second directional guide is spaced axially apart from the first directional guide.

In some embodiments, the method further includes deflecting the intervention assembly along a second guide surface of a second main body of the second directional guide into a second lateral section located adjacent the second directional guide and controlling the intervention assembly to perform another intervention operation within the second lateral section.

In some embodiments, a first diameter of the first bore is larger than a second diameter of the second bore.

In some embodiments, the first outer surface profile has a first shape and the second directional guide has a second outer profile having a second shape that is different from the first shape.

In some embodiments, the method further includes attracting the intervention assembly into the bore.

In some embodiments, the directional guide further includes a magnet or an electronic attraction device.

In some embodiments, the method further includes detecting a presence of the intervention assembly within the bore.

In some embodiments, the directional guide further includes an electronic sensor for detecting the presence of the intervention assembly.

In some embodiments, the method further includes fluidically isolating the lateral section from another lateral section of the multilateral well.

In some embodiments, the directional guide further includes a high-pressure seal that surrounds the main body.

The details of one or more embodiments are set forth in the accompanying drawings and description. Other features, aspects, and advantages of the embodiments will become apparent from the description, drawings, and claims.

DETAILED DESCRIPTION

Figure 1:
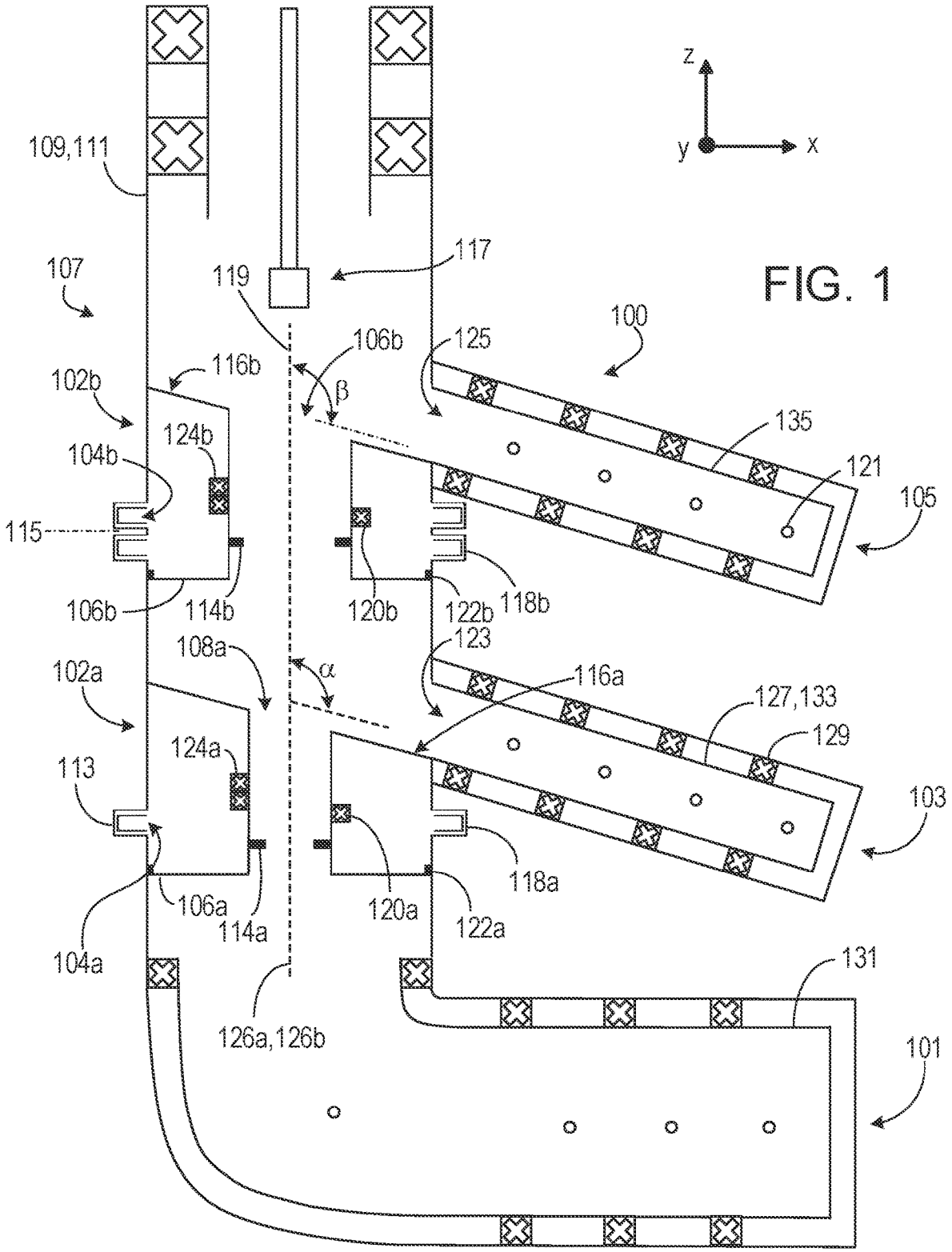
FIG. 1 is a side cross-sectional view of a multilateral well access system installed at a multilateral well.

FIG. 1 illustrates an example multilateral well access system 100 that is designed to facilitate selective access to a target lateral section 101, 103, 105 of a multilateral well 111. The multilateral well access system 100 includes multiple directional guides 102*a*, 102*b* that are positioned along a vertical section 107 of the well 111, as well as multiple cooperating inner surface profiles 104*a*, 104*b* that define vertical positions 113, 115 (for example, depths) of the directional guides 102*a*, 102*b* within the well 111. The inner surface profiles 104*a*, 104*b* are formed as part of a casing 109 that is installed (for example, cemented in place) at the well 111 and are respectively located at the vertical positions 113, 115, just beneath openings 123, 125 of the respective lateral sections 103, 105 of the well 111. The inner surface profiles 104*a*, 104*b* have unique shapes that are formed complementary to mating exterior features of the directional guides 102*a*, 102*b* to securely engage (for example, locate and lock) the directional guides 102*a*, 102*b* at the vertical positions 113, 115.

The directional guides 102*a*, 102*b* are formed to selectively guide an intervention assembly 117 (for example, a bottom hole assembly (BHA)) into the adjacent lateral section 103, 105 or to allow through passage of the intervention assembly 117 for access to the next successive lateral section 101, 103. Each directional guide 102*a*, 102*b* includes a main body 106*a*, 106*b* that is equipped with several functional devices. In an xy plane, each main body 106*a*, 106*b* has a generally annular shape (for example, a shape of a thick-walled cylinder). Each main body 106*a*, 106*b* defines a cylindrical bore 108*a*, 108*b* (for example, a bypass port) that allows through passage of an intervention assembly 117 of a permissible size (for example, a permissible diameter). Each bore 108*a*, 108*b* is respectively centered about a central axis 126*a*, 126*b* of the main body 106*a*, 106*b*.

Each directional guide 102*a*, 102*b* is also provided with an associated entry guide 110*a*, 110*b* (shown in FIGS. 3 and 4) that can be temporarily installed at the bore 108*a*, 108*b*. Each entry guide 110*a*, 110*b* includes a tapered portion with a progressively decreasing diameter that facilitates entry of an intervention assembly 117 into the bore 108, 108*b*. Each directional guide 102*a*, 102*b* is additionally provided with an associated plug 112*a*, 112*b* (shown in FIGS. 2 and 3) that can alternatively be temporarily installed to close the bore 108*a*, 108*b* to prevent through passage of an intervention assembly 117. Accordingly, each main body 106*a*, 106*b* also defines a circumferential landing seat 114*a*, 114*b* (for example, a nipple) that extends radially inward from the bore 108*a*, 108*b* to prevent through passage of the corresponding plug 112*a*, 112*b*. The plugs 112*a*, 112*b* are constructed to mechanically and hydraulically seal against the main bodies 106*a*, 106*b*, respectively.

Each main body 106*a*, 106*b* further defines an upper guide surface 116*a*, 116*b* that is oriented to guide or direct an intervention assembly 117 into the respective lateral section 103, 105. For example, when the main body 106*a*, 106*b* is temporarily plugged, the upper guide surface 116*a*,

116*b* can cause an advancing intervention assembly 117 to selectively deflect into the respective adjacent lateral section 103, 105. Each upper guide surface 116*a*, 116*b* is oriented at an obtuse angle α, β with respect to a central axis 126*a*, 126*b* of the main body 106*a*, 106*b* such that the main body 106*a*, 106*b* has the general shape of a wedge in an xz plane, as illustrated in FIGS. 1-4. Each obtuse angle α, β is typically about equal to an angle of orientation of the respective lateral section 103, 105 and is therefore typically about 95 degrees.

Each directional guide 102*a*, 102*b* also has an outer surface profile 118*a*, 118*b* that is disposed exteriorly along the main body 106*a*, 106*b*. Each outer surface profile 118*a*, 118*b* has a shape that is complementary to the respective inner surface profile 104*a*, 104*b* of the surrounding casing 109. Accordingly, each outer surface profiles 118*a*, 118*b* is formed as a key with a unique shape that allows the directional guide 102*a*, 102*b* to securely and correctly mate with the respective inner surface profile 104*a*, 104*b* at the vertical position 113, 115. The unique shapes of the inner surface profiles 104*a*, 104*b* and the outer surface profiles 118*a*, 118*b* thus prevent positioning of the wrong directional guide 102*a*, 102*b* at any inner surface profile 104*a*, 104*b* along the casing 109. The outer surface profiles 118*a*, 118*b* are designed to land the directional guides 102*a*, 102*b* and accordingly extend around an entire circumference of the main bodies 106*a*, 106*b*. Similarly, the inner surface profiles 104*a*, 104*b* extend around an entire inner circumference of the casing 109 to receive the respective outer surface profiles 118*a*, 118*b* of the directional guides 102*a*, 102*b*.

Example features that may define the geometries of the inner and outer surface profiles 104*a*, 104*b*, 118*a*, 118*c* include projections, protrusions, teeth, recesses, detents, pockets, and the like. The features may have a variety of shapes, such as circular, curved, round, wave-like, rectangular, triangular, linear, etc. In some embodiments, the outer surface profiles 118*a*, 118*b* are embodied as separate, thin components that are respectively assembled with the main bodies 106*a*, 106*b*. In some embodiments, the outer surface profiles 118*a*, 118*b* are formed integrally with the main bodies 106*a*, 106*b*. The directional guides 106*a*, 106*b* are further secured to the casing 109 with packing elements (not shown). The directional guides 106*a*, 106*b* are centered about a central axis 119 of the casing 109, which coincides with the central axes 126*a*, 126*b* of the main bodies 106*a*, 106*b*.

Each main body 106*a*, 106*b* is equipped with a surrounding high-pressure seal 122*a*, 122*b* that fluidically isolates regions of the casing 109 above and below the main body 106*a*, 106*b* to effectively isolate consecutive lateral sections 101, 103, 105 from one another. Additionally, each main body 106*a*, 106*b* is interiorly equipped with one or more attraction devices 124*a*, 124*b* (for example a magnet or an electronic device) that attract the intervention assembly 117. In some embodiments, an intervention assembly 117 may be meant to bypass a non-selected directional guide 102*a*, 102*b* (for example, to run through the directional guide 102*a*, 102*b*) that is equipped with a magnetic sleeve. The intervention assembly 117 may be equipped with magnets that are of the same polarity as those installed to the non-selected directional guide 102*a*, 102*b* to produce a repulsive force that would cause the intervention assembly 117 to bypass the non-selected directional guide 102*a*, 102*b*, but to produce an attractive force that would force the intervention assembly 117 into the appropriate lateral that is adjacent to a selected directional guide 102*a*, 102*b*. Each main body 106*a*, 106*b* is further equipped interiorly with a sensing mechanism 122*a*, 122*b* (for example, an electronic sensor) that can detect entry of an intervention assembly 117 into the bore 108*a*, 108*b*.

The main bodies 106*a*, 106*b* and the outer surface profiles 118*a*, 118*b* of the directional guides 102*a*, 102*b* are typically made of steel, while the plugs 112*a*, 112*b* are typically made of cast iron or aluminum. The main bodies 106*a*, 106*b* of the directional guides 102*a*, 102*b* typically have an outer diameter that is associated with a size of the intervention assembly 117. In some embodiments, a ratio of a diameter of a main body 106*a*, 106*b* of a directional guide 102*a*, 102*b* to a diameter of a corresponding intervention assembly 117 is about 7:2. The bore 108*b* of the upper directional guide 102*b* has a larger diameter than that of the bore 108*a* of the lower directional guide 102*a*. While the example depiction of FIG. 1 illustrates two directional guides 102*a*, 102*b* and corresponding lateral sections 103, 105, in some embodiments, a multilateral well access system 100 may include a different number of directional guides 102 that are each positioned at a corresponding lateral section of a multilateral well 111, as necessary. Consecutive directional guides 102 of a multilateral well access system 100 are typically spaced apart from one another by an axial distance of about 1 m to about 3 m, as determined by the locations of corresponding lateral sections.

FIGS. 1-4 sequentially illustrate an example method of selectively accessing the lateral sections 101, 103, 105 of the multilateral well 111 using the multilateral well access system 100. Referring to FIG. 1, the multilateral well access system 100 can be installed at the multilateral well 111 after the various sections 101, 103, 105, 107 have been drilled and lined with sleeves 131, 133, 135 and with the casing 109. That is, the directional guides 102*a*, 102*b* may be permanently and securely mated to the inner surface profiles 104*a*, 104*b* along the casing 109 at the predefined vertical positions 113, 115. At this stage, production fluid from all of the lateral sections 101, 103, 105 can flow into the vertical section 107 through the bores 108*a*, 108*b* of the directional guides 102*a*, 102*b* and mix to yield a commingled flow. The sleeves 131, 133, 135 may be equipped with multiple inflow control devices (ICDs) 121, tracers 127, and open hole packers 129 to monitor and control flow at the lateral sections 101, 103, 105.

Figure 2:
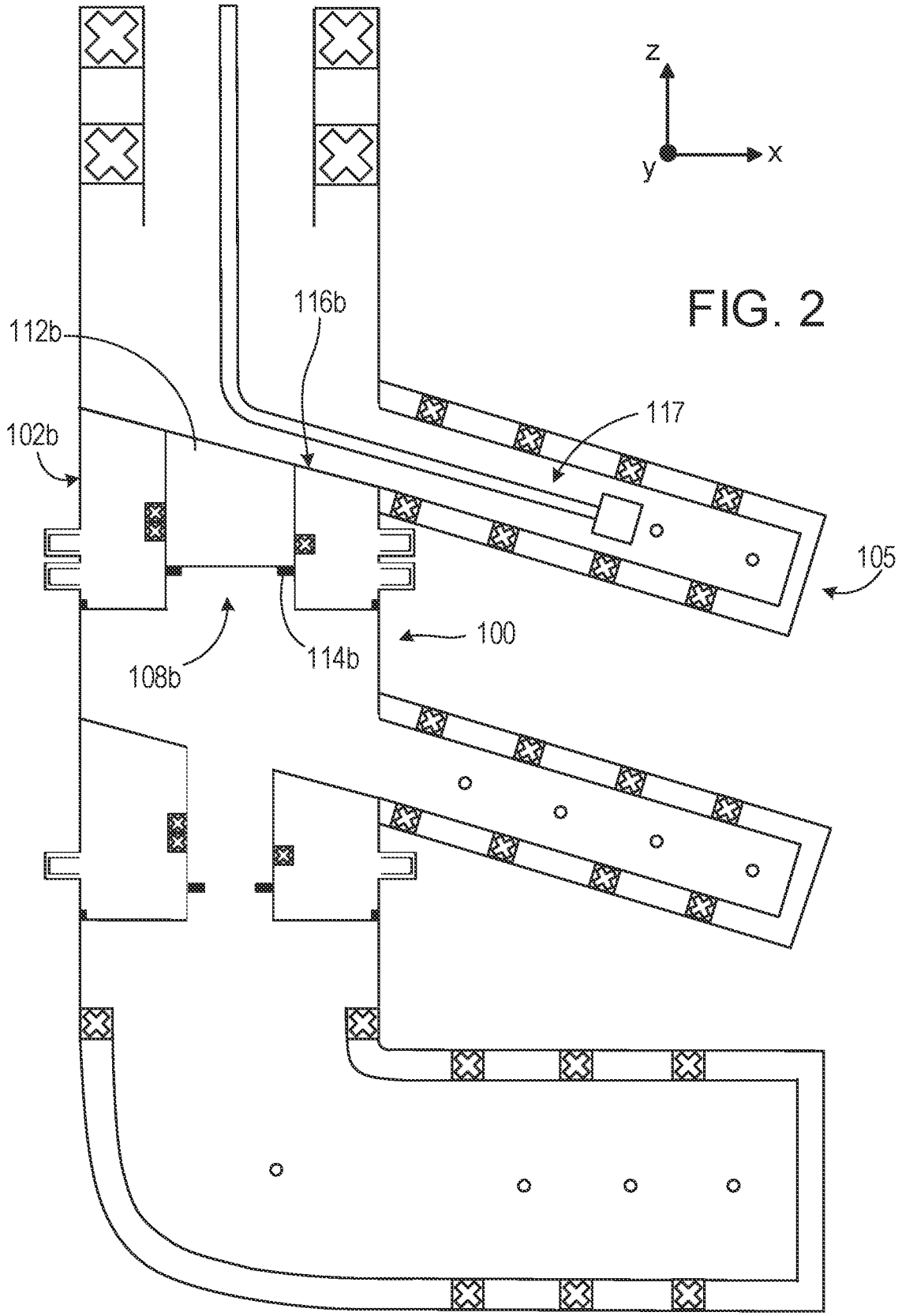
FIGS. 2-4, together with FIG. 1, sequentially illustrate an example method of performing an intervention operation at a multilateral well using the multilateral well access system of FIG. 1.

Referring to FIG. 2, the plug 112*b* may be deployed to the well 111 on a wireline or coil tubing and set on the landing seat 114*b* within the bore 108*b* of the main body 106*b* to close off the bore 108*b*. An intervention assembly 117 may then be run into the well 111 on a coil tubing towards the directional guide 108*b*. Further advancement of the intervention assembly 117 causes the intervention assembly 117 to slide along the upper guide surface 116*b* through the opening 125 to enter the lateral section 105. Once in the lateral section 105, the intervention assembly 117 can be operated to perform any necessary interventions, such as production logging tool operations, shifting of sliding sleeves, and other intervention operations. Upon completion of the intervention operations, the intervention assembly 117 is withdrawn from the well 111, and the plug 112*b* is then withdrawn from the main body 106*b* to allow production from the lower lateral sections 101, 103 to resume.

Figure 3:
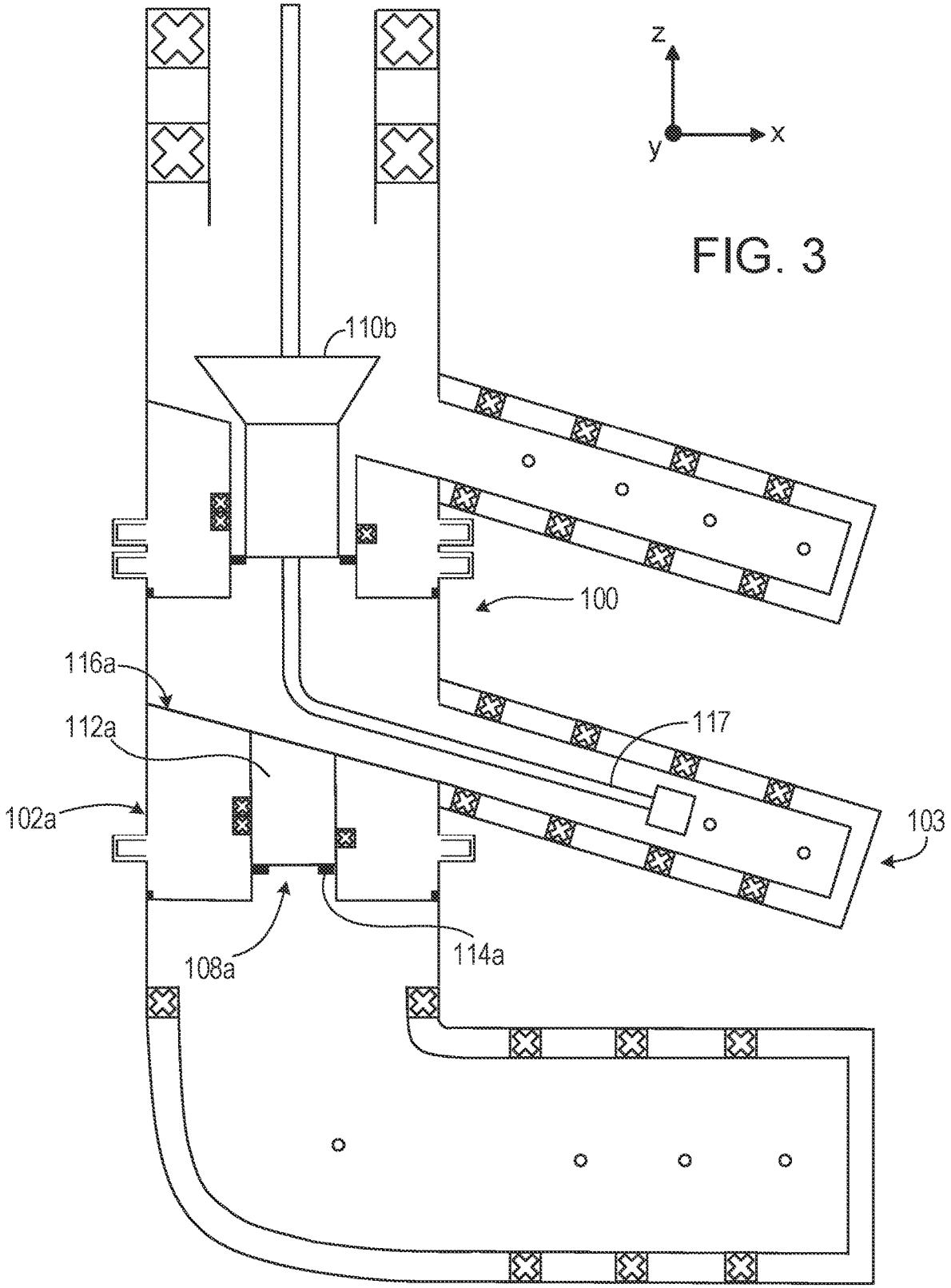

Referring to FIG. 3, the plug 112*a*, having a smaller diameter than that of the bore 108*b*, may be deployed to the well 111 on a wireline or coil tubing and passed through the directional guide 102*b* to access the directional guide 102*a*. The plug 112*a* is then set on the landing seat 114*a* within the bore 108*a* of the main body 106*a* to close off the bore 108*a*. Next, the entry guide 110*b* may be deployed to the well 111 on a wireline or coil tubing and placed within the bore 108*b* of the main body 106*b*. The intervention assembly 117 may then be run into the well 111 on a coil tubing and guided into and through the bore 108*b* with the entry guide 110*b* for access to the directional guide 102*a*. Further advancement of the intervention assembly 117 causes the intervention assembly 117 to slide along the upper guide surface 116*a* through the opening 123 to enter the lateral section 103. Once in the lateral section 103, the intervention assembly 117 can be operated to perform any necessary interventions, such as any of those described above. Upon completion of the intervention operations, the intervention assembly 117 is withdrawn from the well 111 (for example, carrying the entry guide 110*b* out of the well 111), and the plug 112*a* is then withdrawn from the main body 106*a* to allow production from the lower lateral section 101 to resume, thereby again achieving a commingled flow of all of the lateral sections 101, 103, 105.

Figure 4:
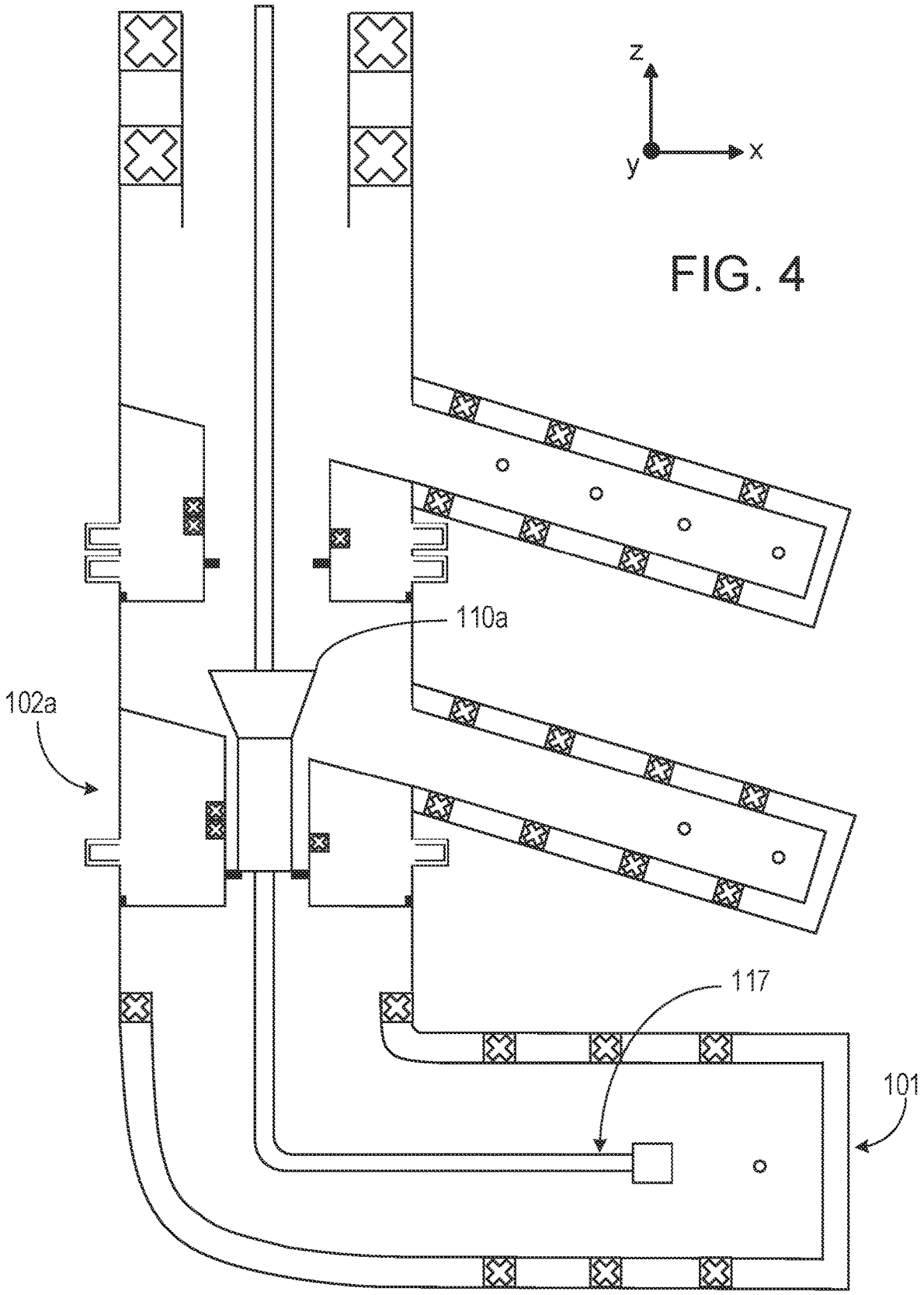

Referring to FIG. 4, the entry guide 110*a* may be deployed to the well 111 on a wireline or coil tubing and placed within the bore 108*a* of the main body 106*a*. The intervention assembly 117 may then be run into the well 111 on a coil tubing and guided into and through the bore 108*a* with the entry guide 110*a* for access to the lowest lateral section 101 (for example, the main bore of the well 111). Once in the lateral section 101, the intervention assembly 117 can again be operated to perform any necessary interventions, such as any of those described above. Upon completion of the intervention operations, the intervention assembly 117 is withdrawn from the well 111 (for example, carrying the entry guide 110*a* out of the well 111) to allow uninhibited commingled production from all of the lateral sections 101, 103, 111 of the well 111 through the bores 108*a*, 108*b* of the directional guides 102*a*, 102*b*.

As described and illustrated above, the directional guides 102*a*, 102*b* are provided as modified whipstocks (for example, hollow whipstocks) that can advantageously allow through-tubing intervention with bypass of the directional guides 102*a*, 102*b* for access to lower lateral sections within a multilateral well 111 in a rig-less manner that does not require removal of the directional guides 102*a*, 102*b*. Furthermore, the directional guides 102*a*, 102*b* still retain a conventional function of guiding an intervention assembly to target lateral sections of the well 111 that are adjacent the directional guides 102*a*, 102*b* along the upper guide surfaces 116*a*, 116*b*. Such improved accessibility can facilitate the acidizing and cleaning out of underperforming laterals, better control of production at selected lateral sections, and the running of logs for understanding performance within a lateral section or a main bore and performing corrective actions via selective shifting to ICD intervals within a lateral section.

Accordingly, utilization of the multilateral well access system 100 can avoid costs and time that would otherwise be associated with removal of the directional guides 102*a*, 102*b* for lower access to provide maximum surveillance and productivity in a cost-effective manner. For example, the multilateral well access system 100 addresses size limitation challenges of deploying re-entry guide tools, avoids upfront installation of sophisticated completion hardware (for example, lateral access systems), avoids the need to add sophisticated tools to wireline or coil tubing (for example, a gamma reader, a casing collar locater, a caliper, or other sensors) to identify a lateral section, and avoids the need to perform random angle changes, as are often required for conventional re-entry tools.

Figure 5:
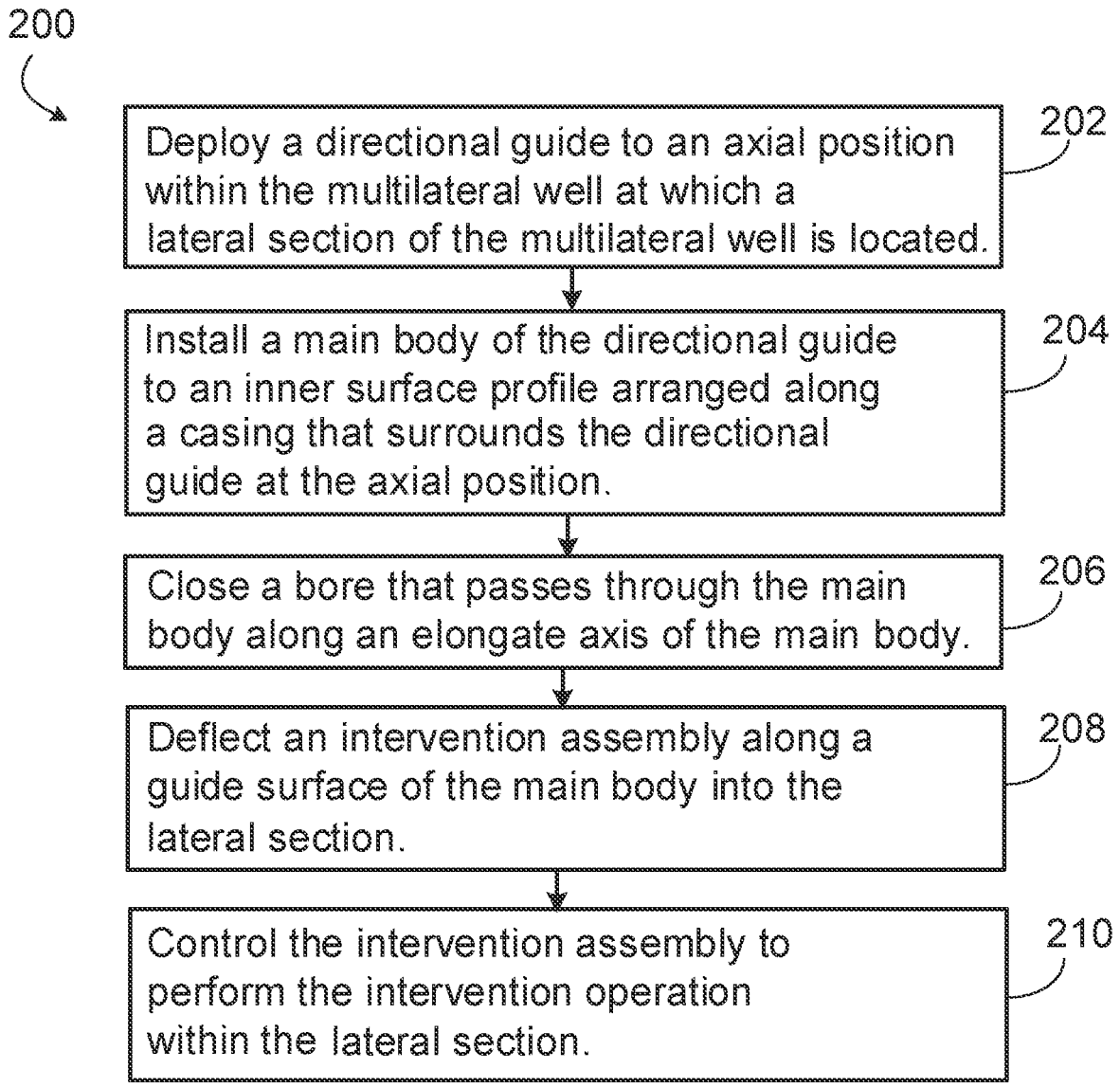
FIG. 5 is a flow chart illustrating an example method of performing an intervention operation at a multilateral well using the multilateral well access system of FIG. 1.

FIG. 5 is a flow chart illustrating an example method 200 of performing an intervention operation at a multilateral well (for example, the multilateral well 111). In some embodiments, the method 200 includes a step 202 for deploying a directional guide (for example, the directional guide 102*b*) to an axial position (for example, the vertical position 115) within the multilateral well at which a lateral section (for example, the lateral section 105) of the multilateral well is located. In some embodiments, the method 200 includes a step 204 for installing a main body (for example, the main body 106*b*) of the directional guide to an inner surface profile (for example, the inner surface profile 104*b*) arranged along a casing (for example, a casing 109) that surrounds the directional guide at the axial position. In some embodiments, the method 200 includes a step 206 for closing a bore (for example, the bore 108*b*) that passes through the main body along an elongate axis (for example, the elongate axis 126*b*) of the main body. In some embodiments, the method 200 includes a step 208 for deflecting an intervention assembly (for example, the intervention assembly 117) along a guide surface (for example, the upper guide surface 116*b*) of the main body into the lateral section. In some embodiments, the method 200 includes a step 210 for controlling the intervention assembly to perform the intervention operation within the lateral section.

While the multilateral well access system 100 has been described and illustrated with respect to certain dimensions, sizes, shapes, arrangements, materials, and methods 200, in some embodiments, any component of a multilateral well access system that is otherwise substantially similar in construction and function to the multilateral well access system 100 may include one or more different dimensions, sizes, shapes, arrangements, configurations, and materials or may be utilized according to different methods.

Accordingly, other embodiments are also within the scope of the following claims.

What is claimed is:

1. A multilateral well access system comprising:
a directional guide comprising:
a main body defining:
a guide surface oriented non-parallelly to an elongate axis of the main body, and
a bore passing through the main body along the elongate axis,
an outer surface profile disposed on the main body, and
an attraction device for attracting a tool to the bore; and
a mating surface profile formed complementary to the outer surface profile and being engaged with the outer surface profile to secure the directional guide in a fixed position.

2. The multilateral well access system of claim 1, wherein the main body has a tapered shape.

3. The multilateral well access system of claim 1, wherein the guide surface is orientated at an obtuse angle with respect to the elongate axis.

4. The multilateral well access system of claim 1, wherein the outer surface profile is positioned on opposite sides of the main body, and wherein the inner surface profile is positioned on the opposite sides of the main body.

5. The multilateral well access system of claim 1, further comprising a plug that is sized to be positioned within the bore to close the bore.

6. The multilateral well access system of claim 5, wherein the main body defines a landing seat that extends within the bore to prevent through passage of the plug.

7. The multilateral well access system of claim 1, further comprising an entry guide that is sized to be positioned within the bore to direct a tool into the bore.

8. The multilateral well access system of claim 7, wherein the entry guide comprises a tapered portion.

9. The multilateral well access system of claim 1, wherein the attraction device comprises one or both of a magnet and an electronic device.

10. The multilateral well access system of claim 1, wherein the directional guide further comprises a detection device for detecting the presence of a tool within the bore.

11. The multilateral well access system of claim 10, wherein the detection devices comprises an electronic sensor.

12. The multilateral well access system of claim 1, wherein the directional guide further comprises a high-pressure seal that surrounds the main body.

13. The multilateral well access system of claim 1, wherein the mating surface profile is arranged on a casing that surrounds the directional guide.

14. The multilateral well access system of claim 1, wherein the directional guide is a first directional guide, the main body is a first main body, the guide surface is a first guide surface, the bore is a first bore having a first diameter, the outer surface profile is a first outer profile, the mating surface profile is a first mating surface profile, and the fixed position is a first fixed position, the multilateral well access system further comprising:

a second directional guide comprising:

a second main body defining:

a second guide surface oriented non-parallelly to an elongate axis of the second main body, and a second bore passing through the second main body along the elongate axis and having a second diameter, and a second outer surface profile disposed on the second main body; and a second mating surface profile formed complementary to the second outer surface profile and being engaged with the second outer surface profile to secure the second directional guide in a second fixed position.

15. The multilateral well access system of claim 14, wherein the second fixed position is downhole of the first fixed position.

16. The multilateral well access system of claim 15, wherein the first diameter of the first bore is larger than the second diameter of the second bore.

17. The multilateral well access system of claim 15, wherein the second directional guide is spaced axially apart from the first directional guide.

18. The multilateral well access system of claim 14, wherein the first outer surface profile has a first shape and the second outer profile has a second shape that is different from the first shape.

19. The multilateral well access system of claim 18, wherein the first mating surface profile is configured to prevent secure positioning of the second directional guide at the first mating surface profile.

* * * * *